US007095302B2

(12) United States Patent
Puskar et al.

(10) Patent No.: US 7,095,302 B2
(45) Date of Patent: Aug. 22, 2006

(54) ROTATING DISPLAY DEVICE AND ELECTRICAL APPARATUS EMPLOYING THE SAME

(75) Inventors: Michael P. Puskar, Carnegie, PA (US); Thomas A. Whitaker, N. Huntingdon, PA (US); Harry J. Carlino, Export, PA (US); Todd M. Shaak, Presto, PA (US)

(73) Assignee: Eaton Corporation, Cleveland, OH (US)

( * ) Notice: Subject to any disclaimer, the term of this patent is extended or adjusted under 35 U.S.C. 154(b) by 142 days.

(21) Appl. No.: 10/852,535

(22) Filed: May 24, 2004

(65) Prior Publication Data

US 2005/0258921 A1 Nov. 24, 2005

(51) Int. Cl.
*H01H 73/12* (2006.01)

(52) U.S. Cl. ..... 335/17; 335/202

(58) Field of Classification Search ..... 335/17, 335/202; 439/11, 164, 13
See application file for complete search history.

(56) References Cited

U.S. PATENT DOCUMENTS 4,513,246 A 4/1985 Blain
4,675,598 A 6/1987 Boichot-Castagne
6,471,529 B1 * 10/2002 Oishi ..... 439/164
6,488,510 B1 * 12/2002 Li ..... 439/13
6,801,426 B1 * 10/2004 Ichimura ..... 361/681
2004/0192073 A1 * 9/2004 Ho et al. ..... 439/13

* cited by examiner

*Primary Examiner*—Lincoln Donovan
(74) *Attorney, Agent, or Firm*—Martin J. Moran

(57) ABSTRACT

A rotating display device displays a value in a variable viewing orientation. The value is received from an electrical apparatus, such as a circuit breaker, having a first port. The rotating display device includes a housing having a first side and a second side, a display disposed on the first side of the housing, a rotating assembly disposed on the second side, and a second port for receiving the value from the first port of the electrical apparatus. The second port communicates with the display and is coupled to the rotating assembly in order to permit the display to rotate. The rotating assembly permits the rotating display device to rotate in the plane of the surface of the circuit breaker on which it is mounted, thereby permitting the display to be quickly and accurately viewed and interpreted regardless of the orientation of the surface to which it is coupled.

24 Claims, 6 Drawing Sheets

ROTATING DISPLAY DEVICE AND ELECTRICAL APPARATUS EMPLOYING THE SAME

BACKGROUND OF THE INVENTION

1. Field of the Invention

The present invention relates generally to electrical apparatus and, more particularly, to a display device for receiving and displaying a value from an electrical apparatus. The invention also relates to an electrical apparatus including a display device.

2. Background Information

Displaying operating parameters (e.g., without limitation, voltage; electrical current; frequency) provides one way for a user to ensure that an electrical apparatus is operating properly. Accordingly, electrical apparatus including electrical switching apparatus, such as circuit switching devices and circuit interrupters (e.g., without limitation, circuit breakers, contactors, motor starters, motor controllers and other load controllers), often include a connector for outputting a value. The value outputted on the connector is typically indicative of one or more operating parameters. Circuit breakers, such as the low voltage circuit breaker 2, shown in FIG. 1, exemplify one type of electrical apparatus that may include such a connector 4.

Circuit breakers are used to protect electrical circuitry from damage due to an over current condition, such as an overload condition or a relatively high level short circuit or fault condition. As shown in FIG. 1, the low voltage circuit breaker 2, for example, includes a housing 6 enclosing at least one pair of separable contacts (not shown) which are operated either manually, by way of an operating handle 8 disposed on the outside of the housing 6, or automatically by way of a trip unit 10 in response to an over current condition. In this example, the circuit breaker trip unit 10 is a modular component that can be interchanged (as best shown in FIG. 2), in order to change the trip characteristics of the circuit breaker 2. As shown, the connector 4, in this case a trip unit testing port, may be located on the trip unit 10. The connector 4 outputs the value, such as, for example, the amount of load current flowing through the circuit breaker 2, to a display device, such as, for example, an ammeter 12 (FIG. 2), in order to display the value on a display 20 thereon.

However, electrical apparatus, including circuit breakers, are often mounted or disposed in a wide variety of orientations with the position of the display device display being dictated by such orientation and the corresponding orientation of the connector on the electrical apparatus. This has made it difficult to read the value displayed on the display when the electrical apparatus is disposed in any orientation other than a vertical one. For example, the circuit breaker discussed above could be mounted sideways in an inverted orientation, thereby requiring the ammeter to be oriented in a corresponding sideways or inverted orientation. This would result in the electrical current value being displayed in an improper orientation making it difficult to be accurately read or interpreted by a user.

SUMMARY OF THE INVENTION

There is, therefore, a need for a rotating display device that can be rotated to permit viewing of the display in a proper viewing orientation regardless of the position of the electrical apparatus to which it is connected.

These needs and others are satisfied by the present invention, which provides a rotating display device for receiving a value from the connector of an electrical apparatus and displaying it in the proper viewing orientation, regardless of the position in which the surface of the electrical apparatus to which it is mounted, is disposed.

As one aspect of the invention, a rotating display device displays a value in a variable viewing orientation, with the value being received from an electrical apparatus having a first port. The rotating display device comprises: a housing including a first side and a second side; a display disposed on the first side of the housing; a rotating assembly disposed on the second side of the housing; and a second port structured to receive the value from the first port of the electrical apparatus, the second port communicating with the display and being coupled to the rotating assembly, in order to permit the display to rotate.

As another aspect of the invention, an electrical apparatus comprises: an enclosure; a first port disposed on the enclosure for outputting a value, the value representing a parameter of the electrical apparatus; and a rotating display device coupled to the first port for receiving the value and displaying it in a variable viewing orientation, the rotating display device comprising: a housing including a first side and a second side; a display disposed on the first side of the housing; a rotating assembly disposed on the second side of the housing; and a second port receiving the value from the first port of the electrical apparatus, the second port communicating with the display and being coupled to the rotating assembly, in order to permit the display to rotate.

The enclosure of the electrical apparatus may include an exposed surface. The rotating display device may be mounted to the exposed surface with the rotating assembly being structured to permit the rotating display device to rotate with respect to the plane of the exposed surface, independent of rotation of the plane of the exposed surface.

The first and second ports may be first and second connectors, respectively. The electrical apparatus may be a circuit breaker, for example, with the rotating display device being a rotating ammeter wherein the value represents an electrical current received from the first connector of the circuit breaker by the second connector of the rotating ammeter and displayed on the display thereof.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

For purposes of illustration, the invention will be described as applied to rotating display devices for displaying a value received from the test port of a low voltage circuit breaker trip unit, although it will become apparent that it could also be applied to other types of circuit breakers (e.g., without limitation, residential circuit breakers; power circuit breakers; molded case circuit breakers), which output a value on a port (e.g., a connector), as well as to other electrical apparatus such as, for example, circuit switching devices and other circuit interrupters such as contactors, motor starters, motor controllers and other load controllers, which output a value on a port (e.g., a connector).

As employed herein, the statement that two or more parts are "coupled" together shall mean that the parts are joined together either directly or joined through one or more intermediate parts.

As employed herein, the term "fastener" refers to any suitable fastening, connecting or tightening mechanism expressly including, but not limited to, screws, bolts and the combination of bolts and nuts.

As employed herein, the term "display device" refers to an apparatus which is structured to receive and display a value that is outputted by the connector of an electrical apparatus. For example, the exemplary rotating display device of the present invention is a rotating ammeter that plugs into, for example, the connector of a circuit breaker, and receives and displays, for example, a load current value.

As employed herein, the term "low voltage circuit breaker" refers to a circuit breaker that generally operates at a voltage rating of less than about 600 volts.

As employed herein, the term "variable viewing orientation" refers to the ability of the display for a rotating display device to be rotated, for example, to a variety of viewing orientations, in order to permit a user to accurately view and interpret the value displayed thereon even when the connector of the electrical apparatus to which it is coupled is disposed in a different or non-standard orientation.

Figure 2:
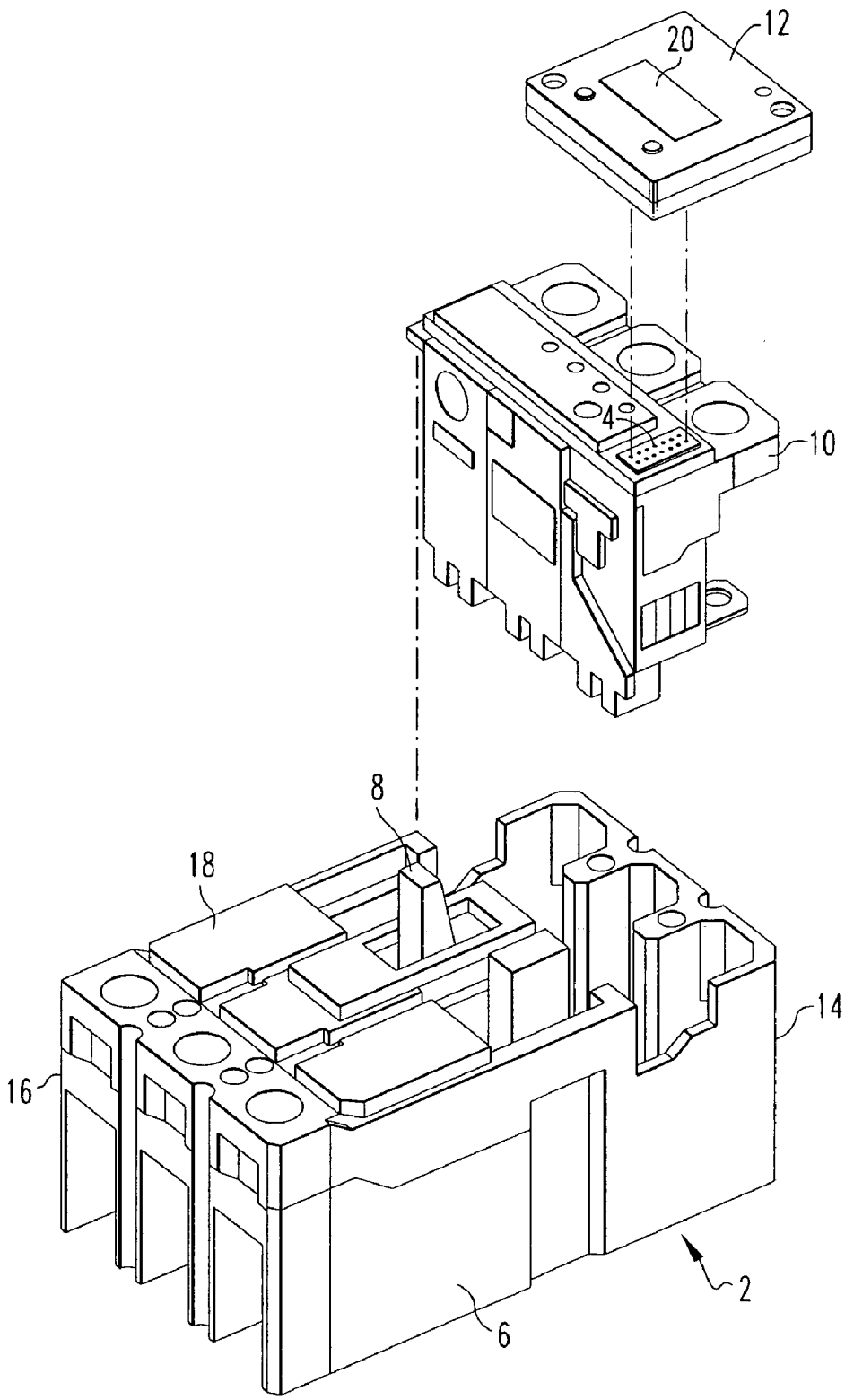
FIG.2 PRIOR ART
FIG. 2 is an exploded isometric view of an electrical apparatus assembly including the circuit breaker of FIG. 1 and a display device.

FIG. 2 illustrates a display device, such as the ammeter 12 shown, for use in receiving and displaying a parameter value from the connector 4 of an electrical apparatus, such as the exemplary low voltage circuit breaker 2. The basic components of the low voltage circuit breaker 2 include the housing 6, the operating handle 8 protruding from an opening in the top of the housing 6 and first and second ends 14, 16, respectively. The exemplary low voltage circuit breaker 2 includes the removable trip unit 10 structured for removable insertion proximate the first end 14 of the housing 6. The exemplary connector is a test port 4 coupled to the top, exposed surface of the trip unit 1 0. The test port 4 is structured to output the value of one or more circuit breaker parameters. The ammeter 12 includes a second connector (not shown) adapted to electrically connect to the test port 4. Once connected, the ammeter 12 receives a value such as, for example, the amount of load current flowing through the circuit breaker 2, and displays such value on the ammeter display 20. However, because the ammeter 12 cannot be rotated with respect to the position in which it is mounted on the test port 4, the orientation in which a user may view the display 20 is dictated by the orientation of the surface 18 of the low voltage circuit breaker 2 to which it is mounted.

Figure 3:
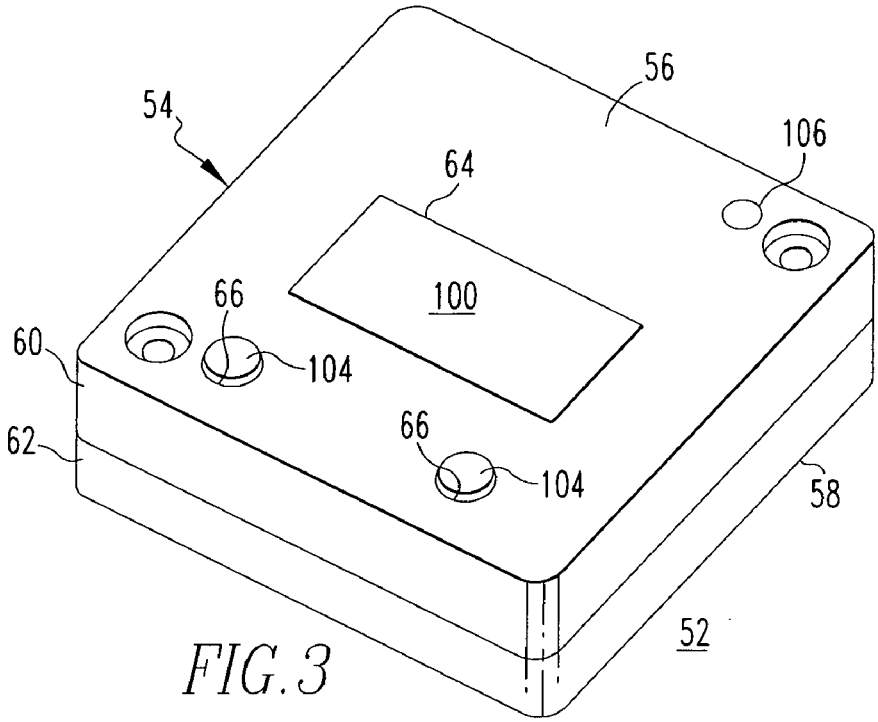
FIG. 3 is an isometric view of the display side of a rotating display device in accordance with the present invention.

FIG. 3 shows a rotating display device in accordance with the present invention, which overcomes this disadvantage. The exemplary rotating display device is a rotating ammeter 52 for displaying the load current value in a variable viewing orientation. As shown, the rotating ammeter 52 includes a housing 54 having a first side 56 and a second side 58. The exemplary housing 54 further includes a first half 60 and a second half 62. A display 100 is disposed in a display opening 64 in the first side 56 of the housing 54. The exemplary display is a digital display 100 for displaying circuit breaker parameters such as, for example, the amount of load current flowing through the low voltage circuit breaker 2, in a digital format which can be quickly and easily read and interpreted by a user. However, it will be appreciated that any suitable alternative display format (not shown) expressly including, but not limited to, an analog display (not shown) or an electromechanical display (not shown) could be employed.

Figure 1:
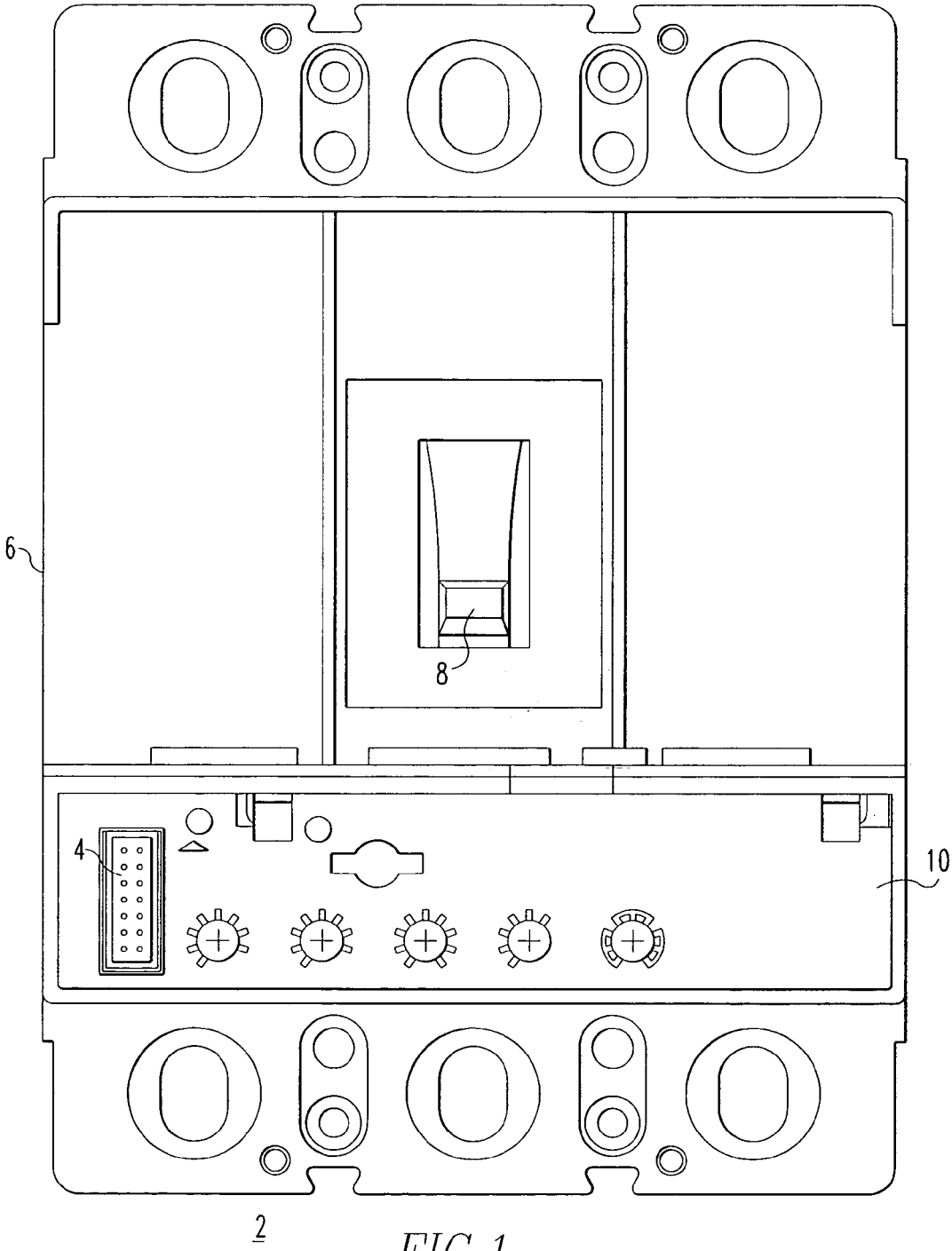
FIG.1 PRIOR ART
FIG. 1 is a vertical elevational view of a low voltage circuit breaker.

Continuing to refer to FIG. 3, the exemplary rotating ammeter 52 also includes a number of control buttons 104 (two are shown in FIG. 3) protruding through openings 66 in the first half 60 of the housing 54. The control buttons 104 are an optional feature designed to permit the user to control the display 100. For example, the control buttons 104 may permit the user to switch the parameter being displayed (e.g., current; voltage) or to change the units in which the parameter is displayed (e.g., amps; milliamps). Additionally, an indicator, such as the exemplary light emitting diode (LED) 106, shown in FIG. 3, may optionally be included for indicating, for example, when the rotating ammeter 52 is electrically connected to the connector 4 (FIG. 1) of the low voltage circuit breaker 2 (FIG. 1). As will be discussed hereinbelow, the exemplary digital display 100 and optional control buttons 104 and LED 106 are electrically connected to a printed circuit board (PCB) 102 (shown in FIG. 5). The PCB 102 (FIG. 5) is electrically connected to a port (e.g., connector 72 (FIGS. 4–6)) of the rotating ammeter 52 by electrical wiring 108 (FIG. 5) or any other suitable alternative communication mechanism, such as another electrical port (e.g., connector)(not shown), an optical port (e.g., connector; output; input)(not shown), or a wireless (e.g., radio frequency (RF); infrared) port (e.g. antenna; output; input)(not shown).

Figure 4:
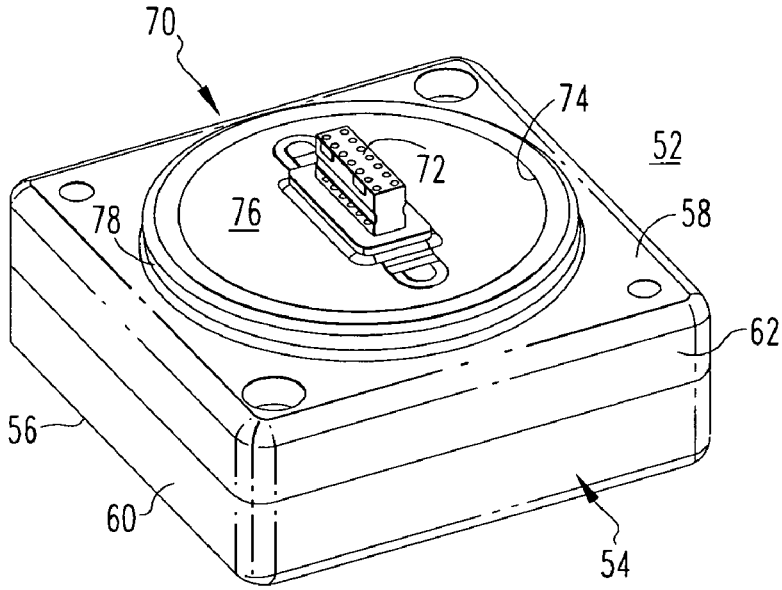
FIG. 4 is an isometric view of the connector side of the rotating display device of FIG. 3.
Figure 5:
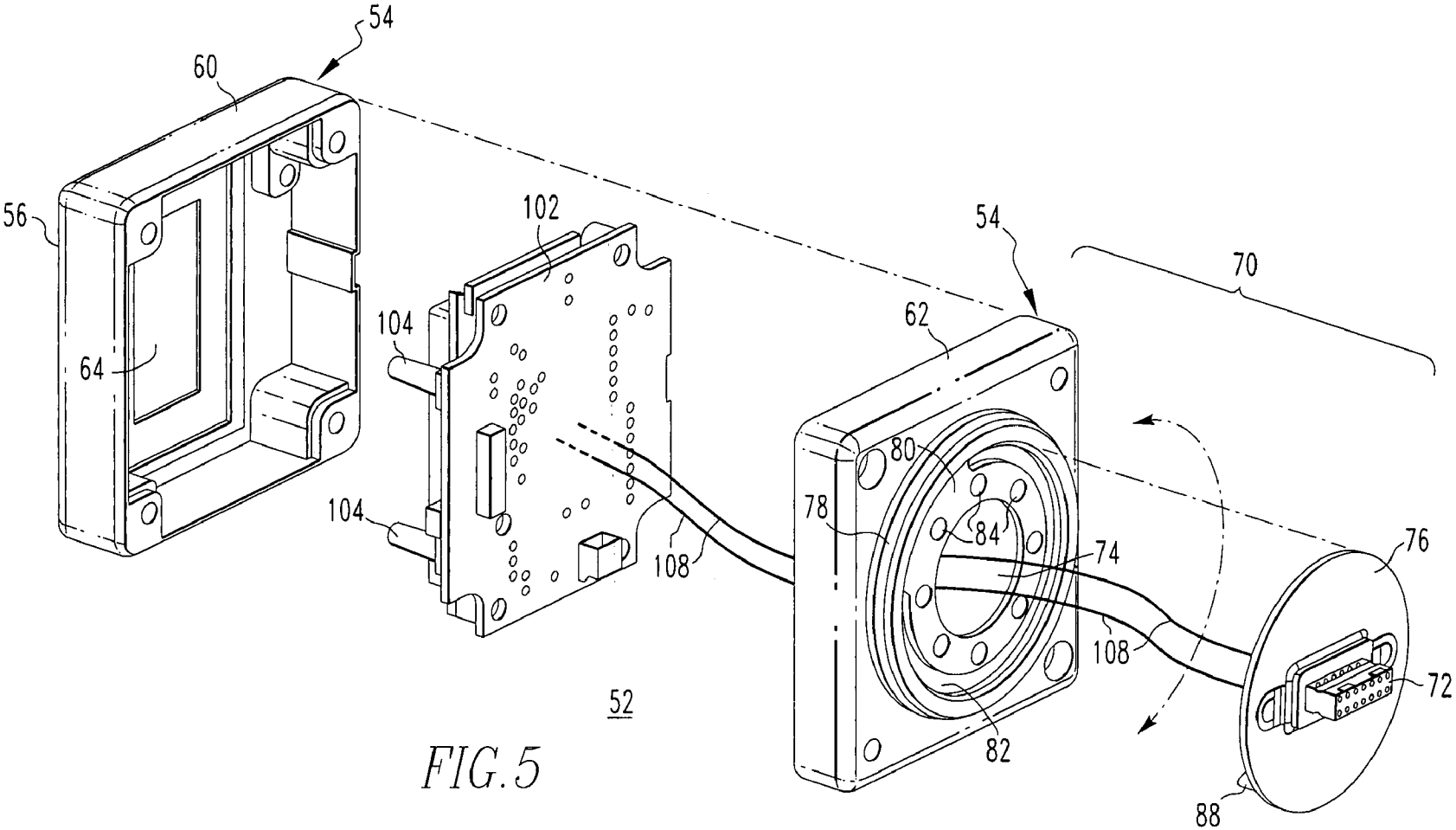
FIG. 5 is an exploded isometric view of the rotating display device of FIG. 4.

Referring now to FIG. 4, the rotating ammeter 52 includes a rotating assembly 70 disposed on the second side 58 of the second half 62 of housing 54. The connector 72, which is structured to receive the value from the connector 4 (as best shown in FIG. 2) on the circuit breaker 2 (FIG. 2), is coupled to the rotating assembly 70 in order to permit the digital display 100 (FIG. 3) to rotate with respect to the circuit breaker 2 (best shown in FIG. 7). As shown, the second side 58 of the housing 54 includes a generally circular aperture 74. A generally circular member 76 is rotatably engaged within the generally circular aperture 74. The exemplary rotating assembly 70 further includes an elevated collar 78 projecting from the second side of the second half 62 of housing 54. The exemplary generally circular aperture 74 is formed through the center of the elevated collar 78 (as best shown in FIG. 5). As will be discussed in detail hereinbelow, the generally circular member 76 is rotatably disposed within the elevated collar 78.

FIG. 5 shows an exploded view of the components of the exemplary rotating ammeter 52, including the exemplary rotating assembly 70. As shown, the first and second halves 60,62 of the rotating ammeter housing 54 enclose the printed circuit board 102 therebetween. The printed circuit board 102 is secured within the housing 54 by being sandwiched between the first and second halves 60, 62, respectively. Any suitable fastener, such as a plurality of screws (not shown), may be employed to secure the first and second halves 60, 62 of the housing 54 together.

The exemplary digital display 100 (FIG. 7) and control buttons 104 are inserted through the display opening 64 and control button openings 66 (FIG. 3), respectively, in the first side 56 of the first half 60 of housing 54. As shown, the exemplary digital display 100 (not shown in FIG. 5) and control buttons 104 are disposed on the printed circuit board 102. As employed, the circuitry (not shown) of the printed circuit board 102 receives the value from the connector 72 and displays it on the digital display 100. The exemplary printed circuit board 102 is electrically connected to the connector 72 on the generally circular member 76 by electrical wires 108. The exemplary wires 108 have a suitable amount of slack to permit the remainder of the housing 54 to rotate with respect to the generally circular member 76 without damaging the wires 108. However, the exact arrangement and number of electrical wires 108 (two electrical wires 108 are shown in FIG. 5) providing the electrical port are not meant to be limiting aspects of the present invention. Moreover, it will be appreciated that, as alternatives to the electrical port, any suitable communication mechanism (not shown) other than the exemplary wires 108, such as another electrical connection or port (not shown), an optical port (not shown), or a wireless (e.g., radio frequency (RF); infrared) port (not shown), may be employed.

As shown, the exemplary circular member 76 is rotatably disposed within a generally circular recessed portion 80 formed in the elevated collar 78 on the second side 58 of the second half 62 of housing 54. The generally circular recessed portion 80 includes an arcuate channel 82, which extends about three-fourths of the way around the generally circular aperture 74. A plurality of holes 84 (e.g., eight holes 84 are shown in FIG. 5) are symmetrically disposed around the periphery of the generally circular aperture 74. A projection 88 on the backside of the generally circular member 76 engages the arcuate channel 82 and slides therein. In this manner, the remainder of the housing 54 and the digital display 100 (FIG. 7) thereon, may rotate with respect to the generally circular member 76, about 270°, which corresponds to the amount the projection 88 may slide within the arcuate channel 82.

By limiting the degrees of rotation, the rotating ammeter 52 is capable of rotating sufficiently enough for the user to view the digital display 100 (FIG. 7) in a wide range of orientations, while preventing the wires 108 or other suitable communication mechanism (not shown), which electrically connects the printed circuit board 102 to the back of the connector 72, from getting entangled or damaged. However, it will be appreciated that the arcuate channel 82 could alternatively extend beyond the exemplary distance of three-fourths of the way around the generally circular aperture 74, thereby permitting the remainder of the housing 54 and the digital display 100 ( FIG. 7) thereon, to rotate greater than the exemplary 270°. For example, if the arcuate recess 82 were to extend almost the entire way around (not shown) the generally circular aperture 74, the housing 54 would be able to rotate up to about 360° with respect to the generally circular member 76 while still preventing the exemplary wires 108 from getting entangled or damaged.

Figure 6:
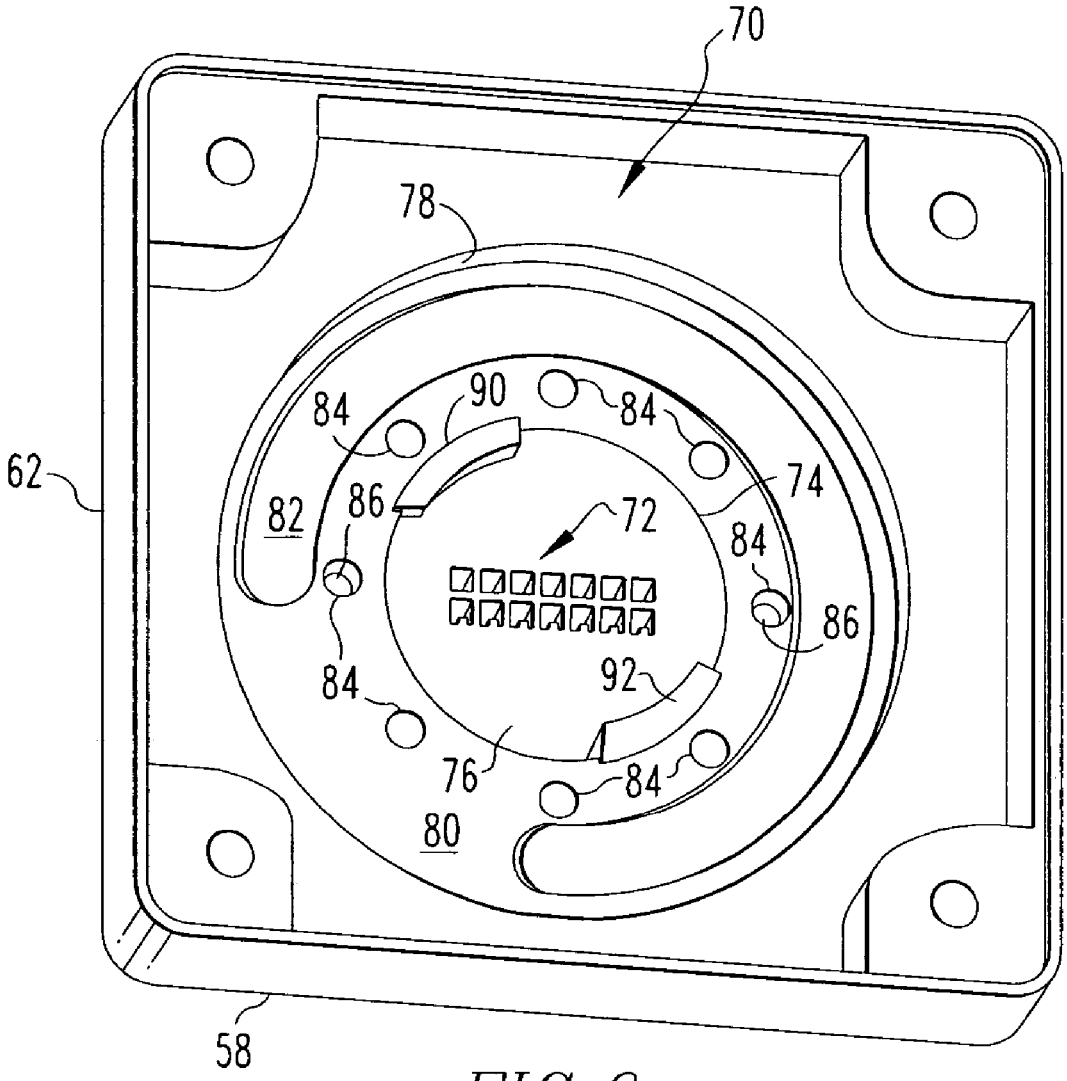
FIG. 6 is an isometric view of the interior of the second half of the housing for the rotating display device of FIG. 5, showing internal structures of the rotating assembly.

FIG. 6 illustrates the interior of the second half 62 of the housing 54 (FIG. 3) and the interior of the rotating assembly 70. As previously discussed, the elevated collar 78 projects from the second side 58 and includes a generally circular recessed portion 80 (as best shown in FIG. 5). The plurality of holes 84 are disposed on the generally circular recessed portion 80, as shown. The back or opposite side of the arcuate channel 82, previously discussed in connection with FIG. 5, appears as an arcuate projection 82 on the generally circular recessed portion 80, which extends about three-fourths of the way around the generally circular aperture 74, as shown.

Continuing to refer to FIG. 6, the generally circular member 76 includes first and second tabs 90, 92 which are inserted through the generally circular aperture 74 and engage the backside of the generally circular recessed portion 80, in order to hold the generally circular member 76 within the elevated collar 78 while permitting it to rotate therein. Specifically, the tabs 90, 92 extend through the generally circular aperture 74 and overlap a portion of the interior side of the generally circular recessed portion 80, as shown. The generally circular member 76 further includes at least one molded knub 86 (two molded knubs 86 are shown in two holes 84 in FIG. 6). As shown, the two molded knubs 86 are structured for insertion into two of the holes 84 disposed around the generally circular aperture 74 in the generally circular recessed portion 80. In this manner, the molded knubs 86 provide some resistance to rotation and temporarily maintain the position of the digital display 100 (FIG. 7) in one of a plurality of predetermined rotated positions corresponding to the locations of the holes 84.

It will be appreciated that any suitable alternative rotating assembly (not shown) could be employed in a wide variety of orientations (not shown) with respect to the housing 54 of the rotating display device 52, in order to permit the rotating display device 52 and the display 100 (FIG. 3) thereon to rotate with respect to the circuit breaker 2 (FIG. 7) to which it is mounted.

Figure 7:
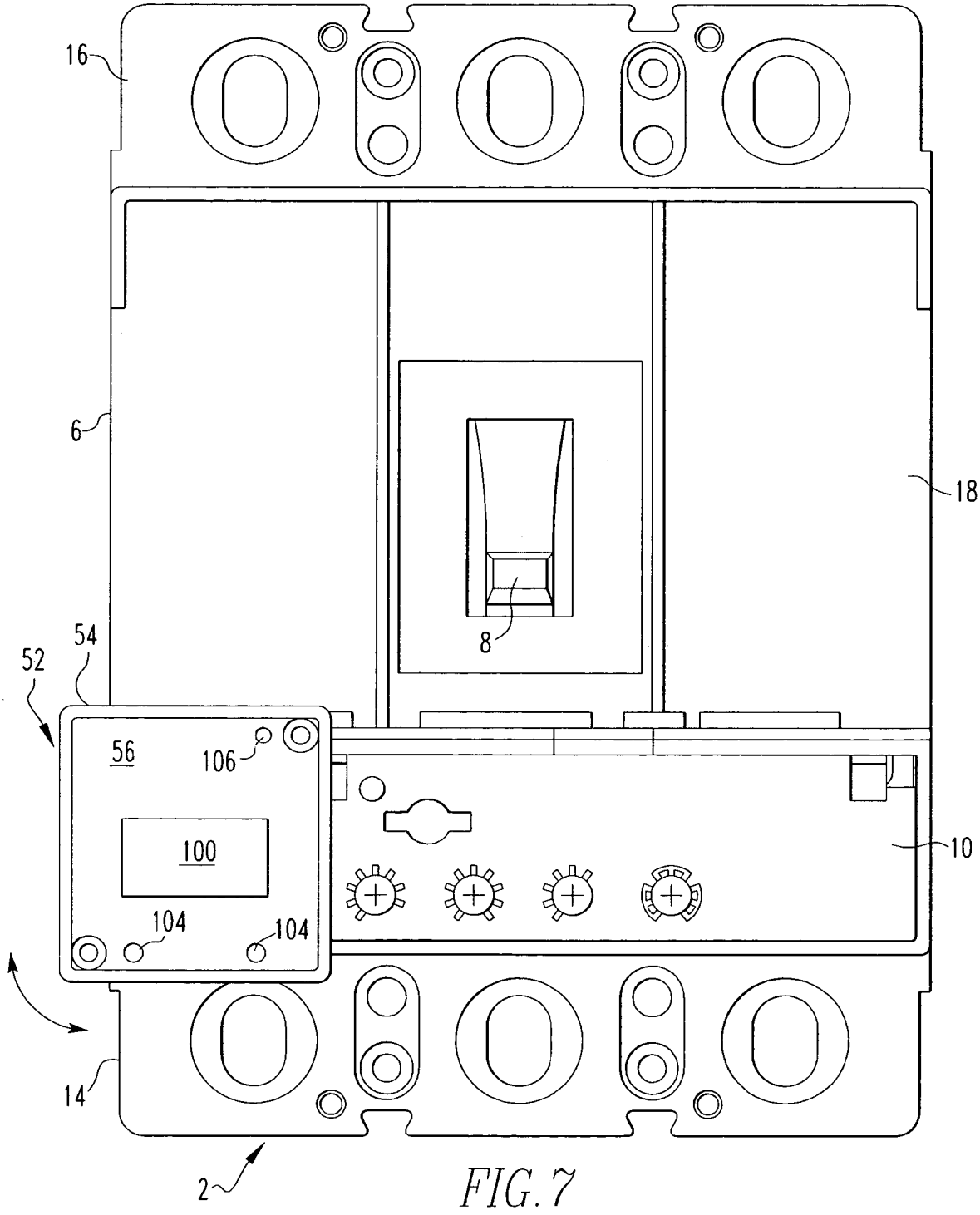
FIG. 7 is a vertical elevational view of the low voltage circuit breaker of FIG. 1 employing the rotating display device of FIG. 3.

FIG. 7 illustrates the exemplary rotating ammeter 52 coupled to the test port 4 (FIG. 2) of the trip unit 10 for the exemplary low voltage circuit breaker 2. As shown, the rotating ammeter 52 is mounted on the exposed surface 18 of the circuit breaker enclosure 6. In this example, the connector 72 (as best shown in FIG. 4) of the rotating assembly 70 (as best shown in FIGS. 5 and 6) is plugged into the test port 4 (FIG. 2), in order to receive a value indicative of the amount of load current flowing through the circuit breaker 2, and display it on the exemplary digital display 100.

The exemplary low voltage circuit breaker 2 shown in FIG. 7 is disposed in a vertical orientation, thus not requiring the rotating ammeter 52 to be rotated in order to view the digital display 100 in the correct orientation (i.e., a substantially vertical orientation). However, as previously discussed, it is well known that electrical apparatus, such as the exemplary circuit breaker 2, may be employed in a variety of applications in which they are required to be disposed in an orientation other than a vertical one. For example, as previously discussed, the exemplary low voltage circuit breaker 2 could alternatively be mounted in a sideways (not shown) or inverted orientation (not shown). Unlike the prior art ammeter 12 discussed above in connection with FIG. 2, which cannot be rotated and would therefore display the value in an undesirable sideways or inverted orientation, the exemplary rotating assembly 70 (FIGS. 5, 6 and 7) permits the rotating ammeter 52 to be rotated, in order for the user to easily and quickly view and interpret the digital display 100 in the correct or substantially vertical orientation, despite the non-vertical or non-standard orientation (not shown) of the exposed circuit breaker surface 18 on which it is mounted.

Accordingly, the present invention provides a simple and effective rotating display device as contrasted with the known prior art. By permitting the display to rotate in the plane of the surface 18 of the electrical apparatus on which it is mounted, the user can easily and quickly view and interpret the display regardless of the orientation of the electrical apparatus surface 18 (e.g., as the surface 18 is rotated clockwise or counterclockwise with respect to FIG. 7) to which it is coupled.

It will also be appreciated that, while for clarity of disclosure, reference has been made herein to the rotating display device as being a rotating ammeter 52 for displaying electrical current values, it could alternatively be another type of rotating display device for displaying a wide variety of parameters other than, or in addition to, electrical current. It will further be appreciated that the rotating display device could employ more than one display (not shown) for displaying a number of such parameters. It will still further be appreciated that the rotating display device may be coupled to an electrical apparatus connector disposed on any surface of the electrical apparatus, in addition to the exposed surface, which has been described herein.

Therefore, while specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A rotating display device for displaying a value in a variable viewing orientation, said value being received from an electrical apparatus having a first port, said rotating display device being independent and removable from said electrical apparatus, said rotating display device comprising:

a housing including a first side and a second side;

a display disposed on the first side of said housing;

a rotating assembly disposed on the second side of said housing; and a second port structured to receive said value from said first port of said electrical apparatus, said second port communicating with said display and being coupled to said rotating assembly, in order to permit said housing and said display disposed on the first side of said housing to rotate independently with respect to said electrical apparatus.

2. The rotating display device of claim 1 wherein said first and second ports are first and second connectors, respectively.

3. The rotating display device of claim 2 wherein said housing includes a first half and a second half, the first half including a display opening for receiving said display; wherein said display is coupled to a printed circuit board which is securely disposed between the first and second halves of said housing; and wherein said printed circuit board is electrically connected to said second connector, said printed circuit board receiving said value from said second connector.

4. The rotating display device of claim 2 wherein said electrical apparatus is a circuit breaker; wherein said rotating display device is a rotating ammeter; and wherein said value represents an electrical current received from said first connector of said circuit breaker by said second connector of said rotating ammeter and displayed on said display thereof.

5. The rotating display device of claim 4 wherein said circuit breaker includes an exposed surface; wherein said rotating ammeter is coupled to said exposed surface; and wherein said rotating assembly is structured to permit said rotating ammeter to rotate with respect to the plane of said exposed surface independent of rotation of the plane of said exposed surface.

6. The rotating display device of claim 5 wherein said circuit breaker includes a first end and a second end; wherein a removable trip unit is disposed at the first end of said circuit breaker; wherein said first connector is a test port disposed on said removable trip unit; and wherein said second connector of said rotating ammeter is structured to plug into said test port of said removable trip unit.

7. The rotating display device of claim 4 wherein said circuit breaker is a low voltage circuit breaker.

8. The rotating display device of claim 2 wherein the second side of said housing includes a generally circular aperture; wherein said rotating assembly includes a generally circular member rotatably engaged within said generally circular aperture; and wherein said second connector is disposed on said generally circular member.

9. The rotating display device of claim 8 wherein said rotating assembly further includes an elevated collar projecting from the second side of said housing; wherein said generally circular aperture is formed through the center of said elevated collar; and wherein said elevated collar is structured to receive said generally circular member within said generally circular aperture and permit it to rotate therein.

10. The rotating display device of claim 9 wherein said elevated collar further includes a generally circular recessed portion structured to receive said generally circular member, said generally circular aperture being formed through the center of said generally circular recessed portion; and wherein said generally circular member includes first and second tabs structured to rotatably secure said generally circular member within said generally circular recessed portion of said elevated collar.

11. The rotating display device of claim 10 wherein said generally circular recessed portion of said elevated collar further includes an arcuate channel and a plurality of holes disposed around said generally circular aperture; wherein said generally circular member further includes a projection and at least one knub; wherein said arcuate channel is structured to receive said projection, in order to permit it to slide therein; and wherein said at least one knub is structured to engage at least one of said holes surrounding said generally circular aperture, in order to temporarily resist further rotation and maintain the position of said generally circular member with respect to said rotating display device housing and said display disposed on the first side thereof.

12. The rotating display device of claim 11 wherein said arcuate channel extends about three-fourths of the way around said generally circular recessed portion, in order to limit travel of said projection therein, thereby limiting rotation of said generally circular member to about 270°.

13. The rotating display device of claim 1 wherein said display is a digital display.

14. An electrical apparatus comprising:

an enclosure;

a first port disposed on said enclosure for outputting a value, said value representing a parameter of said electrical apparatus; and an independent rotating display device removably coupled to said first port for receiving said value and displaying it in a variable viewing orientation, said independent rotating display device comprising:

a housing including a first side and a second side;

a display disposed on the first side of said housing;

a rotating assembly disposed on the second side of said housing; and a second port receiving said value from said first port of said electrical apparatus, said second port communicating with said display and being coupled to said rotating assembly, in order to permit said independent rotating display device to rotate independently with respect to said electrical apparatus to which it is removably coupled.

15. The electrical apparatus of claim 14 wherein said first and second ports are first and second connectors, respectively.

16. The electrical apparatus of claim 15 wherein said housing includes a first half and a second half, the first half including a display opening receiving said display therein; wherein said display is coupled to a printed circuit board which is securely disposed between the first and second halves of said housing; and wherein said printed circuit board is electrically connected to said second connector, said printed circuit board receiving said value from said second connector.

17. The electrical apparatus of claim 15 wherein said electrical apparatus is a circuit breaker; wherein said rotating display device is a rotating ammeter; and wherein said value represents an electrical current received from said first connector of said circuit breaker by said second connector of said rotating ammeter and displayed on said display thereof.

18. The electrical apparatus of claim 17 wherein said enclosure includes an exposed surface; wherein said rotating ammeter is coupled to said exposed surface; and wherein said rotating assembly permits said rotating ammeter to rotate with respect to the plane of said exposed surface independent of rotation of the plane of said exposed surface.

19. The electrical apparatus of claim 18 wherein said circuit breaker includes a first end and a second end; wherein said circuit breaker further includes a removable trip unit disposed at the first end of said circuit breaker; wherein said first connector is a test port disposed on said trip unit; and wherein said second connector of said rotating ammeter plugs into said test port of said trip unit.

20. The electrical apparatus of claim 17 wherein said circuit breaker is a low voltage circuit breaker.

21. The electrical apparatus of claim 15 wherein the second side of said housing includes a generally circular aperture; wherein said rotating assembly includes a generally circular member rotatably engaged within said generally circular aperture; and wherein said second connector is disposed on said generally circular member.

22. The electrical apparatus of claim 21 wherein said rotating assembly further includes an elevated collar projecting from the second side of said housing and having a generally circular recessed portion, which rotatably receives said generally circular member; wherein said generally circular aperture is formed through the center of said generally circular recessed portion; and wherein said generally circular member includes first and second tabs which are inserted through said generally circular aperture, in order to secure said generally circular member within said generally circular recessed portion while permitting it to rotate therein.

23. The electrical apparatus of claim 22 wherein said generally circular recessed portion of said elevated collar further includes an arcuate channel that extends about three-fourths of the way around said generally circular aperture therein, and a plurality of holes disposed around said generally circular aperture; wherein said generally circular member further includes at least one knub and a projection which engages said arcuate channel and slides therein, in order to permit the remainder of said housing of said rotating display device and said display thereon to rotate about 270° with respect to said generally circular member; and wherein said at least one knub on said generally circular member engages at least one of said holes disposed within said generally circular recessed portion, thereby temporarily resisting further rotation and maintaining the position of said housing and said display on the first side thereof in one of a plurality of rotated positions predeterminately established by the location of said holes in said generally circular recessed portion.

24. The electrical apparatus of claim 14 wherein said display is a digital display.

* * * * *